United States Patent [19]

Chimura et al.

[11] 4,000,605

[45] Jan. 4, 1977

[54] METHOD FOR PRODUCING A CRIMPED YARN

[75] Inventors: Kazuya Chimura; Takashi Kaneko; Ryuichi Nakazono; Kenichi Sakunaga, all of Ohtake; Eiji Umemura, Nishinomiya, all of Japan

[73] Assignee: Mitsubishi Rayon Co., Ltd., Osaka, Japan

[22] Filed: Sept. 19, 1972

[21] Appl. No.: 290,318

[30] Foreign Application Priority Data

Sept. 20, 1971 Japan ..... 46-73113
July 19, 1972 Japan ..... 47-72377

[52] U.S. Cl. ..... 57/157 TS
[51] Int. Cl.[2] ..... D02G 1/02
[58] Field of Search ..... 57/157 TS, 34 HS

[56] References Cited

UNITED STATES PATENTS

| | | | |
|---|---|---|---|
| 3,069,837 | 12/1962 | Olson | 57/157 TS |
| 3,094,834 | 6/1963 | Deily et al. | 57/157 TS X |
| 3,404,525 | 10/1968 | Tompkins | 57/157 TS |
| 3,435,603 | 4/1969 | Rice | 57/157 TS X |
| 3,535,866 | 10/1970 | Tsuruto et al. | 57/34 HS |
| 3,581,487 | 1/1971 | Loomes et al. | 57/34 HS |
| 3,691,750 | 9/1972 | Waters | 57/157 TS UX |

*Primary Examiner*—Donald O. Woodiel
*Assistant Examiner*—Charles Gorenstein
*Attorney, Agent, or Firm*—Armstrong, Nikaido & Wegner

[57] ABSTRACT

Method for producing a crimped yarn in which a thermoplastic yarn is false twisted at a speed exceeding 300 m/min. by using a twisting tube comprising a friction twisting surface of wear-resistant material having a high frictional coefficient, the false twisting being performed under a particular relationship among the yarn speed, surface speed of the twisting tube, denier of the yarn, and the yarn tension at the inlet and outlet sides of the twisting tube.

1 Claim, 5 Drawing Figures

METHOD FOR PRODUCING A CRIMPED YARN

Figure 1:
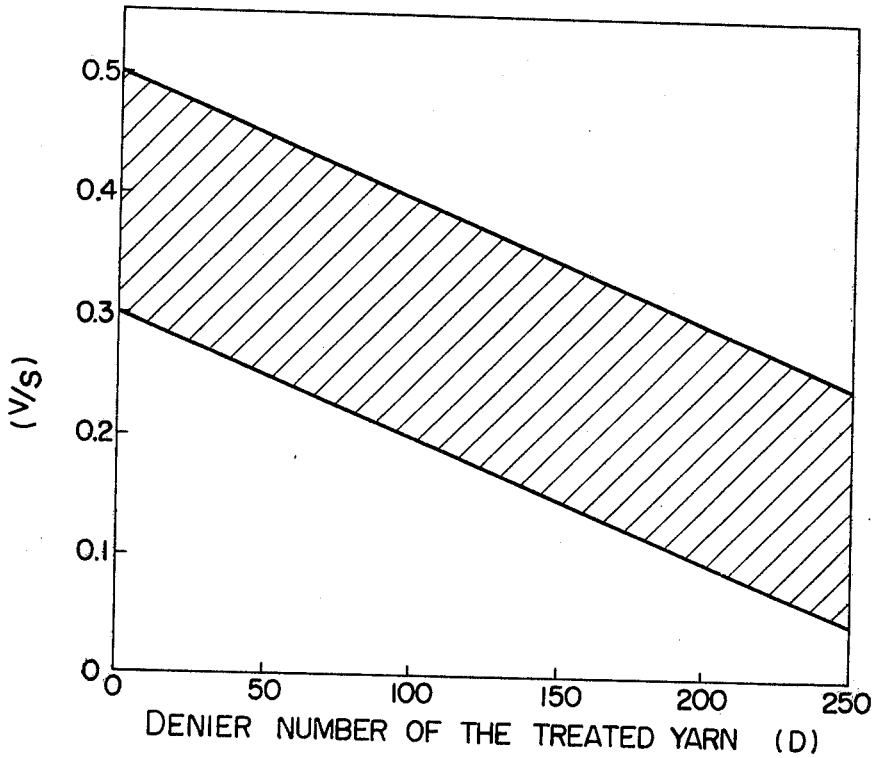

The present invention relates to an improvement in a method for producing crimped yarns.

Hithertofore, it has been known for producing crimped yarns at a high speed to use a twisting tube having a frictional twisting surface made of a material of high frictional coefficient and a high wear-resistant property, such as polyurethane. However, such a friction twisting method is disadvantageous in that there is often produced fluctuation in number of twist when the yarns are subjected to false twist operation under a yarn speed of 300 to 800 m/min. which speed is often employed in a drawing operation of polyester or polyamide yarns, so that it is very difficult to provide a uniform twist which is essential to obtain a desirable crimp for a long period. Particularly, when the yarns are of large denier, the tension of the yarn is remarkably increased at the outlet of the twisting tube resulting in a deterioration in crimp property and formation of fluffs, or finally causing breaking of yarns.

The inventors have continued investigations for solving the above problems of the prior art and obtaining a method which can readily produce crimped yarns of desired property through a friction type false twisting process even under a yarn speed exceeding 300 m/min. and achieved the present invention. Thus, the present invention provides a method for producing crimped yarns in which thermoplastic synthetic yarns are passed at a speed exceeding 300 m/min. through a twisting tube having a twisting friction surface of wear-resistant material of high frictional coefficient to apply false twisting to the yarns, characterized by the fact that the false twisting is performed under the conditions meeting the requirements of the following equations:

$$(300-D)/10^3 \leqq V/S \leqq (500-D)/10^3 \quad \text{(I)}$$

$$T_2/T_1 \leqq 2 \quad \text{(II)}$$

where:

$V$ = yarn speed in m/min. at the friction twisting surface;

$S$ = surface speed in m/min. at the center of the yarn engaging portion of the friction twisting surface;

$D$ = the denier of the yarn to be treated;

$T_1$ = yarn tension in grams at the inlet side of the twisting tube; and $T_2$ = yarn tension in grams at the outlet side of the twisting tube.

Generally speaking, when a false twisting operation is performed under a high speed, it is particularly important to insert a high and uniform twist and to maintain a proper tension of a running yarn. Particularly, when a friction false twisting process is employed, it is very important however very difficult to meet the above two requirements.

In a friction false twisting process, in order to obtain a high twist level, it is necessary to have an increased contact pressure between the friction twisting surface and a yarn to be twisted. However, since an increase in the contact pressure causes a corresponding increase in the yarn tension, if the contact pressure is increased under a high speed, such as a speed exceeding 300 m/min., the yarn tension is remarkably increased at the outlet side of the twisting tube due to a substantial increase in friction between the twisting surface and the yarn. Thus, fluffs are produced in the yarn or breaking of the yarn is experienced. Further, the heat set crimps are destroyed due to the increased tension of the yarn, resulting in a remarkably deteriorated crimp property.

The inventors have found that, under a condition in which the value V/S is between $(300-D)/10^3$ and $(500-D)/10^3$ and in which the ratio $T_2/T_1$ is less than 2, it is possible to obtain uniform and high crimps level even under a high speed exceeding 300 m/min. and thus to obtain uniform and bulky crimped yarns.

Figure 2A:
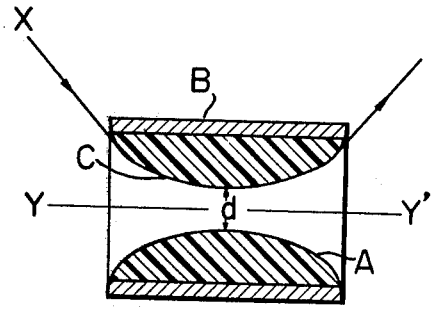
Figure 2B:
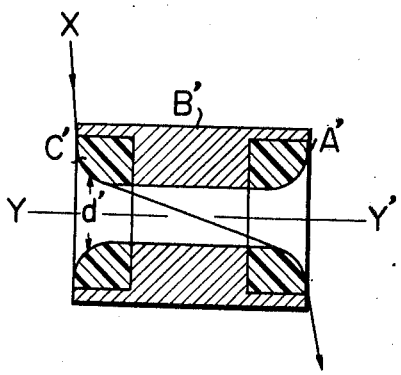
Figure 3:
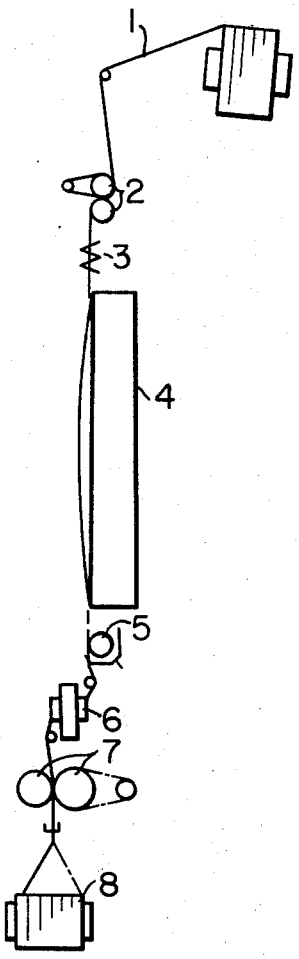
Figure 4:
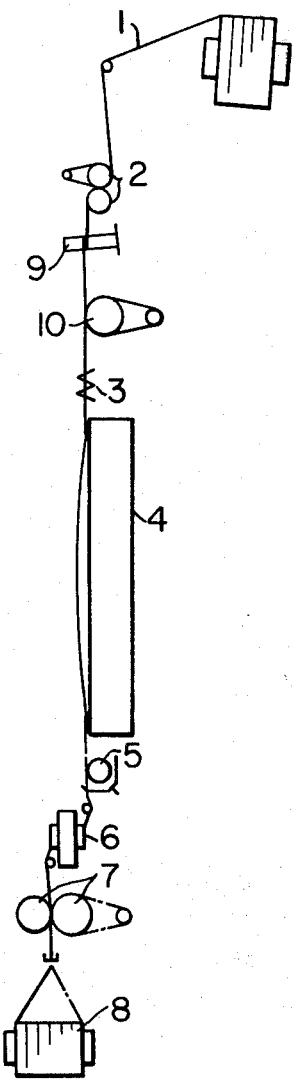

The present invention will further be described taking reference to the accompanying drawings, in which;

FIG. 1 is a diagram showing the twisting conditions in accordance with the present invention;

FIGS. 2 *a* and *b* show in longitudinal section examples of the twisting tube which may be employed in the process of the present invention; and, FIGS. 3 and 4 show diagrammatical side views of examples of the apparatus which may be employed in the process of the present invention.

Referring to the drawings, particularly to FIG. 1, there is shown a preferred range of the value V/S by a shadowed area. When the value V/S exceeds $(500-D)/10^3$, the number of twist is remarkably decreased and the ratio $T_2/T_1$ is remarkably increased. Under such a condition, fluffs and capillary breaks are often encountered in the yarn and the crimps property of the yarn is also deteriorated. Conversely, if the value is less than $(300-D)/10^3$, the number of twist is increased and moreover fluctuation in number of twist is experienced. Such a condition causes untwisting spot in the textured yarn. Further, the ratio $T_2/T_1$ must necessarily be limited below 2 in order to prevent presentation of fluffs and capillary breaks of the yarn and to be able to insert a high twist level in the yarn. Such a ratio $T_2/T_1$ can be readily obtained by limiting the value V/S in the range as specified by the equation (I) and, at the same time, by using a twisting tube of a type as shown in FIG. 2*a* or 2*b*. In FIGS. 2*a* and 2*b*, each of the reference characters B and B′ designates a metal pipe and each of the reference characters A and A′ designates a wear-resistant material of high friction coefficient, such as polyurethane, which is secured to the metal pipe B or B′. The characters C and C′ designate friction twisting surfaces, X a yarn and Y—Y′ an axis of rotation of the twisting tube.

According to the present invention, it is possible to apply a false twisting to a preliminary drawn yarn as well as to undrawn yarn. Further, it is of course possible to have a yarn subjected to drawing and thereafter to a false twisting without winding it after the drawing operation. FIG. 3 shows a side view of an apparatus for performing a false twisting operation with a drawing operation. In the apparatus, a undrawn yarn 1 of a thermoplastic synthetic material is drawn to a predetermined ratio by means of a feed roll 2 and a delivery roll 7 which is rotated with a surface speed higher than that of the roll 2. At the same time, the yarn 1 is subjected to twisting, heat setting and untwisting by means of a flase twisting heater 4 and a twisting tube 6. Thereafter, it is cooled by cooling roll 5 provided below the false twisting heater 4 and finally wound on a bobbin 8. In this method in which drawing and false twisting are simultaneously performed, it is preferable for improving a processability, and crimp and dyeing property of the yarn to employed a highly oriented undrawn yarn which is obtained by a high speed spinning. When a polyester yarn is treated, a preferable result can be obtained when a undrawn yarn having birefringence of at least $15 \times 10^{-3}$ is used and the ratio of drawing is determined to a value less than 3.0, preferably less than 2.4. In case of a polyamide yarn such as nylon 6 and nylon 66, a preferable result can be obtained under a similar condition.

FIG. 4 shows side view of an apparatus in which a yarn is drawn and then false twisted. In the apparatus, an undrawn yarn 1 is drawn with a suitable draw ratio, preferably a maximum draw ratio of 65 to 85 percent between a feed roll 2 and a drawing roll 10, a drawing pin 9 being used to fix the neck point of drawn yarn. Then, the yarn 1 is subjected to twisting, heat setting and untwisting by means of a false twisting heater 4 and a twisting tube 6 disposed between the drawing roll 10 and a delivery roll 7, and thereafter it is cooled by a cooling roll 5 disposed beneath the heater 4 and wound on a bobbin 8. In this method in which false twisting is performed just after drawing, a preferable crimp property can be obtained when a polyester yarn is drawn under the temperature less than 150° C, preferably less than 130° C in the drawing zone. This would be theoretically explained that since a internal structure of relatively loose inter connection can be obtained through drawing under the low temperature, the internal structure of the yarn can be easily deformed during the false twisting.

According to the present invention, it is also possible to produce a so-called "set-type" treated yarn by heat treating a yarn under a loosened condition such as by continuously feeding the yarn under a overfeed ratio of about 10 percent without winding it after the false twisting. Although the present invention is applicable to all thermoplastic synthetic yarns which can be false twisted, it is particularly suitable for the treatment of polyester or polyamide yarn. Further, the present invention is applicable to a treatment of a yarn of any size up to 250 denier, a preferable range being between 20 to 200 denier.

Thus, the present invention has the above described features and can perform a false twisting operation at a rate exceeding 300 m/min. The crimped yarns made in accordance with the present invention are substantially free from fluffs and have uniform crimp property. Examples of the present invention will now be described.

In the following description, the ratio of under-feed is defined by the following formula, $$\text{under-feed ratio } (\%) = (V_2 - V_1)/V_1 \times 100$$

where:

$V_1$ = the surface speed of the feed roll 2 in the apparatus shown in FIG. 3; the surface speed of the drawing roll 10 in the apparatus shown in FIG. 4.

$V_2$ = the surface speed of the delivery roll 7.

The crimp confraction was measured as follows, a skein having a diameter of 50 cm under a condition of reduced tension is prepared, and wrapped by a gauge and subjected to a heat treatment. The heat treatment is performed by dipping the skein in water of 70° C for 20 minutes in case of nylon 6 or nylon 66 yarns or in water of 95° C for 20 minutes in case of polyester yarns. Thereafter, the skein is dried under a free state. The dried skein is then subjected to a light load (2 mg/*d*) and a heavy load (0.2 g/*d*). After one minute, the length $l_1$ of the skein is recorded and then the large load is removed. After 1 minute, the length $l_2$ of the skein is recorded. The crimp contraction is calculated by the following formula, $$\text{crimp ratio } (\%) = (l_1 - l_2)/l_1 \times 100$$

EXAMPLE 1

An apparatus as shown in FIG. 3 and having a twisting tube shown in FIG. 2*a* with the diameter-(d) of 30 mm at the center portion of the yarn engagement portion of the friction twisting surface was used to treat nylon 66 drafted yarn of 50 denier-17 filaments and 20 denier-3 filaments under various V/S values with the heater temperature of 220° C and the ratio of under-feed of 5 %. The results of the false twisting are shown in Table 1.

Table 1

| Sample | Yarn | Yarn speed | V/S | number of twist (turns/m.) | $T_2/T_1$ | Crimp ratio | Remarks |
|---|---|---|---|---|---|---|---|
| 1 | 50 d/17f | 500 (m/min.) | 0.50 | 3500 | 3.2 | 35.2 | many fluffs, less bulkiness |
| 2 | | | 0.40 | 4400 | 1.8 | 55.2 | uniform crimp, good bulkiness |
| 3 | | | 0.33 | 4500 | 1.6 | 60.1 | uniform crimp, good bulkiness |
| 4 | | | 0.21 | 3800 | 1.2 | — | non-uniform twist |
| 5 | 20 d/3f | 800 (m/min.) | 0.57 | 5590 | 3.6 | 36.7 | many fluffs, less bulkiness |
| 6 | | | 0.45 | 6200 | 1.9 | 50.7 | uniform crimp, good bulkiness |
| 7 | | | 0.38 | 6390 | 1.7 | 51.2 | uniform crimp, good bulkiness |
| 8 | | | 0.26 | 5900 | 1.3 | — | non-uniform twist |

EXAMPLE 2

An apparatus as shown in FIG. 3 and having a twisting tube shown in FIG. 2*b* with the diameter-(d) of 35 mm at the center portion of the yarn engaging portion of the friction twisting surface was used to treat polyethyleneterephthalate drawn yarns of various denier with the false twisting heater temperature of 230° C, the ratio of under-feed of 5 % and various V/S values. The results of the false twisting is shown in Table 2.

Table 2

| Sample | Yarn | Yarn speed | V/S | Number of twist (turns/m.) | $T_2/T_1$ | Crimp ratio (%) | Remarks |
|---|---|---|---|---|---|---|---|
| 9 | | | 0.50 | 3300 | 3.3 | — | many fluffs, no crimp |
| 10 | | | 0.41 | 4200 | 1.9 | 43.2 | uniform crimp, good bulkiness |
| | 50 d/24f | 600 (m/min.) | | | | | |
| 11 | | | 0.35 | 4400 | 1.7 | 45.3 | uniform crimp, good bulkiness |
| 12 | | | 0.23 | 3700 | 1.3 | — | non-uniform twist |
| 13 | | | 0.48 | 3000 | 3.1 | 30.5 | many fluffs, less bulkiness |
| 14 | | | 0.38 | 3400 | 1.7 | 41.5 | uniform crimp, good bulkiness |
| | 75 d/36f | 500 (m/min.) | | | | | |
| 15 | | | 0.29 | 3550 | 1.4 | 42.3 | uniform crimp, good bulkiness |
| 16 | | | 0.21 | 3100 | 1.2 | — | non-uniform twist |
| 17 | | | 0.45 | 2000 | 2.3 | 25.6 | many fluffs, less bulkiness |
| 18 | | | 0.33 | 2450 | 1.4 | 40.5 | uniform crimp, good bulkiness |
| | 150 d/30f | 400 (m/min.) | | | | | |
| 19 | | | 0.20 | 2500 | 1.3 | 41.5 | uniform crimp, good bulkiness |
| 20 | | | 0.12 | 2100 | 1.1 | — | non-uniform twist |

EXAMPLE 3

In an apparatus as shown in FIG. 4, a twisting tube 6 as shown FIG. 2 *b* is provided. The twisting tube 6 had an inner diameter *d' of* 35 mm a heating plate (not shown) is additionally provided between the drawing pin 9 and the drawing roll 10. An undrawn polyethyleneterephthalate yarns of 520 denier-30 filaments were drawn under the drawing pin temperature of 95° C, the draw ratio of 3.6 and the heating plate temperature of 150° C, and thereafter false twisted under the false twisting heater temperature of 240° C, the ratio of under-feed of 5 percent, the yarn speed of 600 m/min, and various V/S values. The treated yarns were of 150 denier-36 filament. The results are shown in Table 3.

Table 3

| Sample | V/S | Number of twist (turns/m) | $T_2/T_1$ | Crimp ratio | Remarks |
|---|---|---|---|---|---|
| 21 | 0.37 | 1800 | 1.5 | 26.8 | many fluffs, less bulkiness |
| 22 | 0.30 | 2400 | 1.4 | 38.4 | uniform crimp, good bulkiness |
| 23 | 0.18 | 2580 | 1.2 | 40.2 | uniform crimp, good bulkiness |

EXAMPLE 4

An apparatus as shown in FIG. 4 and having a twisting tube as shown in FIG. 2*b* with the diameter *d'* of 35 mm was used to treat undrawn nylon 66 yarns of 165 denier-17 filaments. The yarns were initially drawn under a room temperature at a drafting ratio of 3.3 and then false twisted at the false twisting temperature of 230° C, the ratio of under-feed of 5 percent, the yarn speed of 600 m/min. and various V/S values. The results are shown in Table 4. The treated yarns were of 50 denier-17 filaments.

Table 4

| Sample | V/S | Number of twist (turns/m) | $T_2/T_1$ | Crimp contraction (%) | Remarks |
|---|---|---|---|---|---|
| 24 | 0.55 | 3100 | 4.1 | — | many fluffs, impossible to apply further treatments |
| 25 | 0.42 | 3800 | 1.9 | 51 | uniform crimp, good bulkiness |
| 26 | 0.36 | 4000 | 1.7 | 56 | uniform crimp, good bulkiness |
| 27 | 0.22 | 3600 | 1.3 | — | non-uniform twist |

EXAMPLE 5

The apparatus used in the Example 4 was again used to treat undrawn polyethyleneterephthalate yarns of 240 denier-36 filaments. The yarns were drawn under the drawing pin temperature of 95° C and at the draw ratio of 3.2, and then false twisted under the false twisting heater temperature of 230° C with the under-feed ratio of 5 percent, the V/S value of 0.30 and various yarn speeds. The results are shown in Table 5. The treated yarns were of 75 denier-36 filaments and the ratio $T_2/T_1$ was 1.4 to 1.5.

Table 5

| Sample | Yarn speed (m/min.) | Number of twist (turns/m) | Crimp ratio (%) | Remarks |
|---|---|---|---|---|
| 28 | 400 | 3650 | 47.0 | Uniform crimp, good bulkiness |
| 29 | 500 | 3550 | 45.5 | uniform crimp, good bulkiness |
| 30 | 600 | 3500 | 45.2 | uniform crimp, good bulkiness |
| 31 | 700 | 3300 | 43.0 | uniform crimp, good bulkiness |

EXAMPLE 6

The apparatus used in the Example 3 was again used to treat undrawn polyester yarns of 520 denier-30 filaments. The yarns were drawn at the draw ratio of 3.3 under various temperatures, and then false twisted under the false twisting heater temperature of 230° C with the ratio of under-feed of 5 percent, the V/S value of 0.25 and the yarn speed of 600 m/min. The result is shown in Table 6. The treated yarns were of 150 denier-30 filaments, and the ratio $T_2/T_1$ was 1.3.

Table 6

| Sample | Drafting temperature (° C) | Number of twist (turns/m) | Crimp ratio | Remarks |
|---|---|---|---|---|
| 32 | pin (110), heating plate (not used) | 2600 | 42.0 | uniform crimp, good bulkiness |
| 33 | pin (110), heating plate (130) | 2550 | 40.5 | uniform crimp, good bulkiness |
| 34 | pin (110), heating plate (160) | 2470 | 34.2 | slightly inferior bulkiness |

EXAMPLE 7

Polyethyleneterephthalate of relative viscosity of 1.64 was spun at various spinning speed and the obtained undrawn yarns were drawn and false twisted using the same apparatus as used in the Example 2 at the yarn speed of 350 m/min., the heating plate temperature of 210° C, the V/S value of 0.28 and with various ratio of under-feed. The results are shown in Table 7. The treated yarn was 150 denier-30 filament, and the ratio $T_2/T_1$ was 1.4.

Table 7

| Sample | Spinning speed (m/min.) | Δ n of non-drafted yarn | ratio of under-feed (%) | process-ability |
|---|---|---|---|---|
| 35 | 1200 | $8 \times 10^{-3}$ | 245 | impossible |
| 36 | 1500 | $13 \times 10^{-3}$ | 210 | difficult |
| 37 | 1800 | $15 \times 10^{-3}$ | 190 | rather good |
| 38 | 2000 | $20 \times 10^{-3}$ | 150 | good |
| 39 | 3200 | $47 \times 10^{-3}$ | 65 | good |
| 40 | 4500 | $75 \times 10^{-3}$ | 10 | good |

EXAMPLE 8

Undrawn polyethyleneterephthalate yarns of 265 denier-30 filaments which were spinned at the speed of 3200 m/min. and which had birefringence $47 \times 10^{-3}$ were drawn and false twisted using the same apparatus as used in the Example 2 with the ratio of under-feed of 65 percent and at the yarn speed of 500 m/min., the heating plate temperature of 230° C and various value of V/S. The results are shown in Table 8. The treated yarn was 150 denier-30 filaments.

Table 8

| Sample | V/S | $T_2/T_1$ | Number of twist (turns/m.) | Crimp ratio (%) | Remarks |
|---|---|---|---|---|---|
| 41 | 0.37 | 2.2 | 2000 | 26.8 | many fluffs, |

Table 8-continued

| Sample | V/S | $T_2/T_1$ | Number of twist (turns/m.) | Crimp ratio (%) | Remarks |
|---|---|---|---|---|---|
| | | | | | less bulkiness |
| 42 | 0.30 | 1.5 | 2600 | 47.7 | uniform crimp, good bulkiness |
| 43 | 0.18 | 1.2 | 2500 | 45.0 | uniform crimp, good bulkiness |
| 44 | 0.15 | 1.1 | 2000 | 27.0 | non-uniform twist, non-uniform crimp |

EXAMPLE 9

Undrawn nylon 6 yarns of 105 denier-17 filaments which were spinned at the speed of 3000 m/min. and which had the birefringence $42 \times 10^{-3}$ were drawn and false twisted using the same apparatus as used in the Example 2 with the ratio of under-feed of 50 percent at the false twisting heater temperature 180° C., the yarn speed of 500 m/min. and various V/S value. The results are shown in Table 9. The treated yarns were 70 denier-17 filaments.

Table 9

| Sample | V/S | $T_2/T_1$ | Number of twist (turns/m.) | Crimp ratio (%) | Remarks |
|---|---|---|---|---|---|
| 45 | 0.50 | 3.1 | 3000 | — | Many fluffs, no appearance of crimped yarns |
| 46 | 0.37 | 1.8 | 3620 | 53.0 | uniform crimp, good bulkiness |
| 47 | 0.26 | 1.5 | 3700 | 54.0 | uniform crimp, good bulkiness |
| 48 | 0.21 | 1.2 | 2900 | 40.2 | non-uniform twist, non-uniform crimp |

We claim:

1. Method for producing a crimped yarn in which thermoplastic synthetic undrawn polyester yarn having birefringence of at least $15 \times 10^{-3}$ is passed at a speed exceeding .300 m/min. through a twisting tube having a twisting friction surface of wear-resistant material of high frictional coefficient to apply false twisting to the yarn simultaneously with drawing at an underfeed ratio less than 200 per cent, characterized by the fact that the false twisting is performed under the condition meeting the requirements of the following equations;

$$(300-D)/10^3 \leqq V/S \leqq (500-D)/10^3 \quad \text{(I)}$$

$$T_2/T_1 \leqq 2 \quad \text{(II)}$$

where:

$V$= yarn speed in m/min. at the friction twisting surface;

$S$= surface speed in m/min. at the center of the yarn engaging portion of the friction twisting surface;

$D$= denier of the treated yarn;

$T_1$= tension of yarn is grams at the inlet side of the twisting tube; and, $T_2$= tension of yarn is grams at the outlet side of the twisting tube.

* * * * *